United States Patent [19]

Keable

[11] Patent Number: 4,674,438

[45] Date of Patent: Jun. 23, 1987

[54] PHOTOGRAPHIC FILM COATER

[75] Inventor: John B. Keable, Kettering, Ohio

[73] Assignee: QMI Corporation, Dayton, Ohio

[21] Appl. No.: 818,316

[22] Filed: Jan. 13, 1986

[51] Int. Cl.[4] ..... B05C 1/08; B05C 11/02

[52] U.S. Cl. ..... 118/642; 118/118; 118/124; 118/223

[58] Field of Search ..... 118/641, 642, 124, 118, 118/223, 227; 354/339, 338, 321; 226/91, 92

[56] References Cited

U.S. PATENT DOCUMENTS

| | | | |
|---|---|---|---|
| 2,199,228 | 4/1940 | Obenshain et al. | 118/223 X |
| 2,383,964 | 9/1945 | Grupe | 118/118 X |
| 2,933,417 | 4/1960 | McIntyre, Jr. | 118/124 X |
| 4,122,218 | 10/1978 | Bostrum et al. | 118/642 X |

*Primary Examiner*—John P. McIntosh

*Attorney, Agent, or Firm*—Biebel, French & Nauman

[57] ABSTRACT

A film coater apparatus applies an ultraviolet light curable coating to the opposite side of filmstrips in which the filmstrip is initially supported at one end on a plastic leader, includes a coater formed with complementary leader guiding passageways in the opposite side walls of the coater which guide the leader through the coater in non-contacting relation to the offset coater applicator rolls and to the smoother bars so that coating material is not built-up on the leader. The coater apparatus is self-threading and includes an inlet drive roll, an ultraviolet light curing chamber, and an outlet drive pinch roll assembly which serves to grip the leader and thereafter to grip and drive the filmstrips through the coater. The outlet pinch rolls provide a draw or tension to the film to assure the desired delivery of the filmstrips through the coater and in contacting relation to the coating and smoothing elements therein.

4 Claims, 4 Drawing Figures

PHOTOGRAPHIC FILM COATER

BACKGROUND OF THE INVENTION

In the copending application Ser. No. 715,447, filed Mar. 25, 1985 now U.S. Pat. No. 4,612,875, incorporated herein by reference, there is disclosed apparatus for simultaneously coating the opposite sides of an elongated strip of film with an ultraviolet curable coating. The apparatus disclosed in that application, employing offset coating applicator rolls and smoothing bars, has been highly successful in applying a controlled thickness of such coating material to elongated strips of photographic film, such as 35 millimeter film. However, there exists a need for a more compact machine which is compatible with the "one hour" photographic processing techniques and apparatus in common use, for the processing of consumer films, such as strips of 35 millimeter, and 110 and 126 type films. Also, such equipment can be used with other film formats, such as 70 millimeter, 105 millimeter and for microfilm processing. Such coater apparatus must be compact, accept the film leaders commonly used in such small scale integrated photograhic film developing and printing apparatus, and must be essentially self-threading so that the film can be applied thereto and coated with minimum manual labor or delay.

SUMMARY OF THE INVENTION

This invention is directed to a compact film coater for applying an ultraviolet curable coating to the opposite sides of developed strip-type film, and more particularly to such apparatus which is adapted to be used in conjunction with rapid integrated processing apparatus, such as commonly used for one-hour processing. In particular, the coater of the present invention is designed to accept the film leaders to which the filmstrips are now applied in the rapid processing setups, and to provide automatic threading and coating followed by curing of such filmstrips.

A particular feature of the present invention resides in its ability to accept the film leaders presently in use, which normally consist of an elongated strip of clear plastic polyethylene material, of a width which usually substantially exceeds one or more widths of film to be developed and/or handled or printed when attached to the ends of such strips. In applying such ultraviolet coating, it is important that the leaders bring the filmstrips through the coater in such a manner that coating is not applied to the leaders, in order to avoid a build up of coating on the leaders which will eventually crack and begin to break off as the thickness increases. Therefore, it is desirable to bring the leaders through the coaters automatically without application of coating thereto.

In the preferred embodiment of this invention, this is accomplished by providing a coater having side frame members, in which there are defined complementary guide slots which are proportioned and positioned to receive the leader strip at the opposite side edges thereof and which guide the leader strip through the coater apparatus in non-contacting relation to coating and smoothing elements therein which have coating material thereon.

More particularly, a serpentine-like left and right-hand slot is formed in the respective side stands or side frame members of the coater which together guide the leader strip through a coating tower in non-contacting relation to the offset coating rolls and the smoothing bars so as to pull the attached filmstrips therethrough. The filmstrips become coated by proper application to the coating apparatus, since the filmstrips have a width less than that of the leader strip and are thus engaged by the coating apparatus.

Accordingly, it is an object of the present invention to provide a coater apparatus for applying an ultraviolet curable coating material to photographic strip films and the like which is adapted for use as a component part of, or as an addition to, existing small batch film developing apparatus, in which a leader strip is attached to the leading edge of one or more strips of film for guiding the same through the developing, printing and coating apparatus.

A further object of the invention is the provision of a small coater apparatus adapted to apply ultraviolet curable coating material to the opposite side of photographic filmstrips and for curing the same.

A still further object of the invention is the provision of a self-threading coater apparatus adapted to permit a plastic leader to pass through the coater without application on or build-up of coating material on the leader while providing for accurate application of coating material to filmstrips carried therethrough by such leader.

These and other objects and advantages of the invention will be apparent from the following description, the accompanying drawings and the appended claims.

DESCRIPTION OF THE PREFERRED EMBODIMENT

Figure 1:
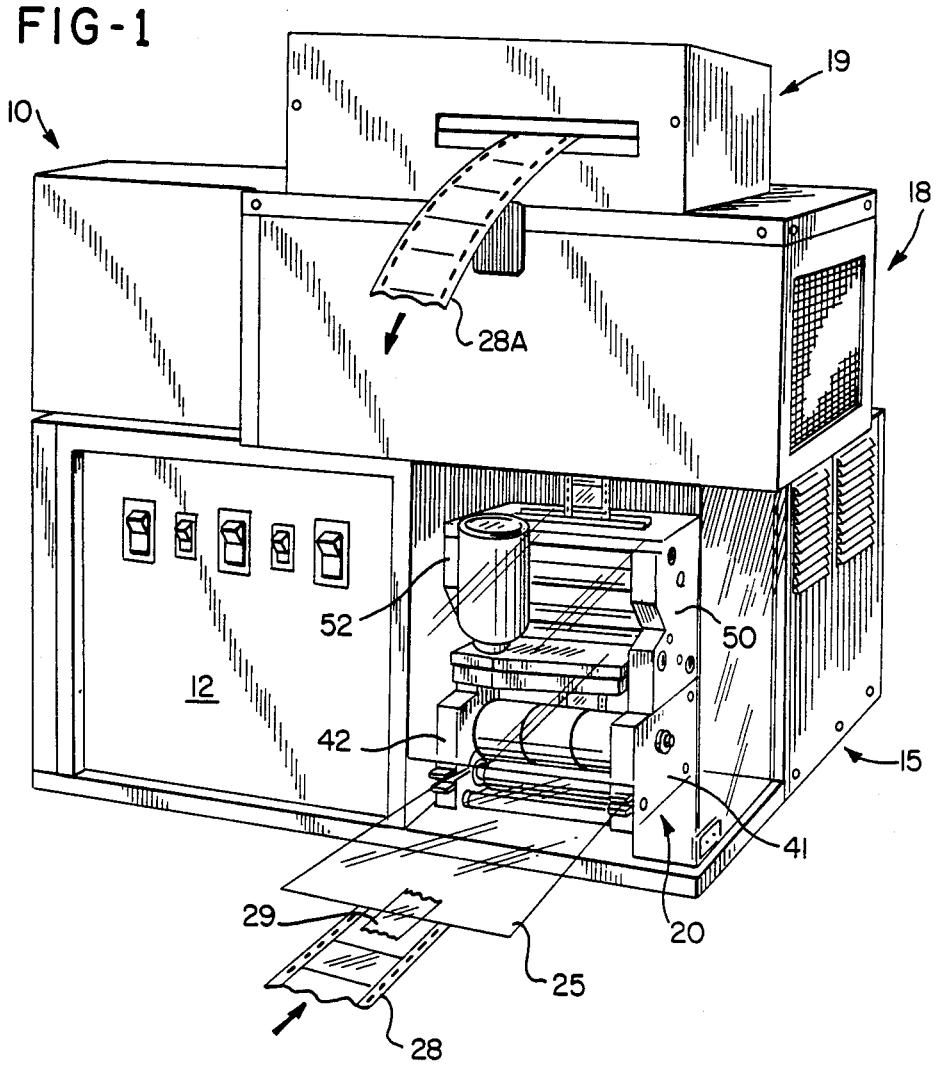
FIG. 1 is a perspective view of a film coater in accordance with this invention.

Referring to the figures of the drawing which illustrate a preferred embodiment of the invention, a film coater constructed according to this invention, adapted to apply a protective ultraviolet curable, clear film coating to the opposite sides of a strip of film is illustrated in FIG. 1 as having a cabinet 10. The cabinet 10 may have a plurality of sections including a control section 12, a coater section 15, a curing section 18, and an output drive section 19.

The invention is primarily directed to the coater section 15 which contains coating apparatus illustrated generally at 20. The coating apparatus or coater 20 receives therein a plastic leader strip 25, shown in FIG. 1, to which may be attached to one or more filmstrips 28. The filmstrip 28 is shown as being attached to the trailing end of the leader 25 by a strip of adhesive 29. FIG. 1 also shows a second coated filmstrip **28*a* extending from the output cabinet section 19** with the leader removed for the purpose of clarity of illustration.

As previously noted, commercial photographic film developing machines in common use for rapid processing of consumer film products, such as 135 millimeter, 110 and 126 type films are brought into and through the automatic developing, washing and drying apparatus by a short section of clear polyethylene leader, which may be 4½ or 5 inches wide, as examples. The filmstrips 28 are attached to the trailing end of such a leader 25 as shown in FIG. 1. It has been found that it is desirable to cause the leader to go through the coater 20 in such a manner that no coating is applied to the leader itself, to prevent an accumulation or build-up of coating on the leader.

The coater 20 is preferably of the general type which is described and claimed in the copending application Ser. No. 715,447, previously mentioned, and is a two-sided vertical coater employing offset coating rolls with smoothing bars or rolls, to apply a precisely metered quantity of ultraviolet coating material to the opposite sides of each filmstrip.

The ultraviolet curing cabinet section 18 is mounted immediately above the coating section and is adapted to receive the filmstrips through a light barrier from the coater 20 as drawn by the output drive cabinet section 19. The ultraviolet section includes a pair of ultraviolet lamps 30 and 31 with appropriate reflectors 32 and 33, to direct curing light simultaneously to the opposite sides of the film. The film is drawn therethrough by means of a pinch roll drive 35 diagrammatically illustrated in FIG. 4, consisting of a driven roll 36 and an idler roll 37, to deliver the filmstrip 28 through a forward exit slot 38 formed in the front wall of the output drive cabinet section 19.

The input drive to the coater section 20 includes a bottom motor driven roll 40 mounted between a pair of side frames 41 and 42. A pinch roll 43 (FIG. 4) is carried on a pivot arm 44. The pinch roll 43 is biased by the arm 44 about a pivot 45 by a tension spring 46. Preferably the rolls 36 and 37 of the output drive 35 are caused to operate at a surface speed slightly faster than the input roll 40, to cause a slight amount of draw as the film progresses through the coater and dryer apparatus.

The ultraviolet curing lamps 30 and 31 may be of the mercury-vapor type, as described in the copending application, and may be rated at 85 watts per inch or more to cure the coating material, which may be in the order 2–3 microns in thickness. This curing will take place in a few seconds.

Figure 3:
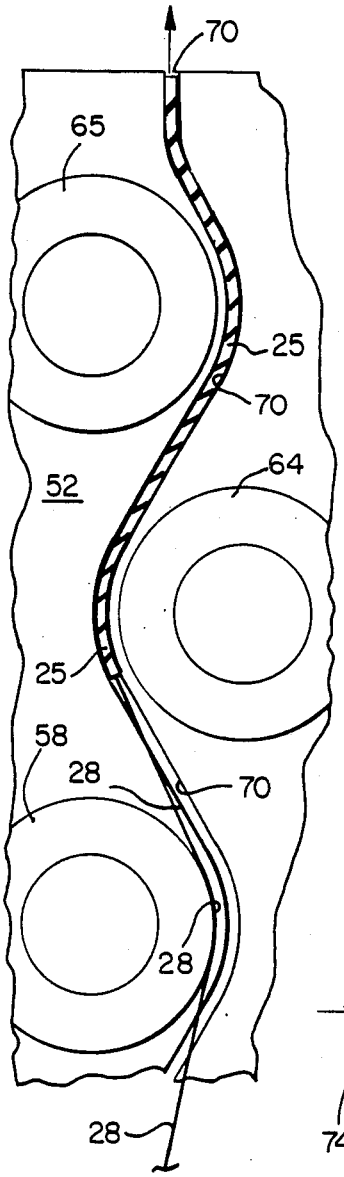
FIG. 3 is an enlarged fragmentary view of FIG. 2.
Figure 4:
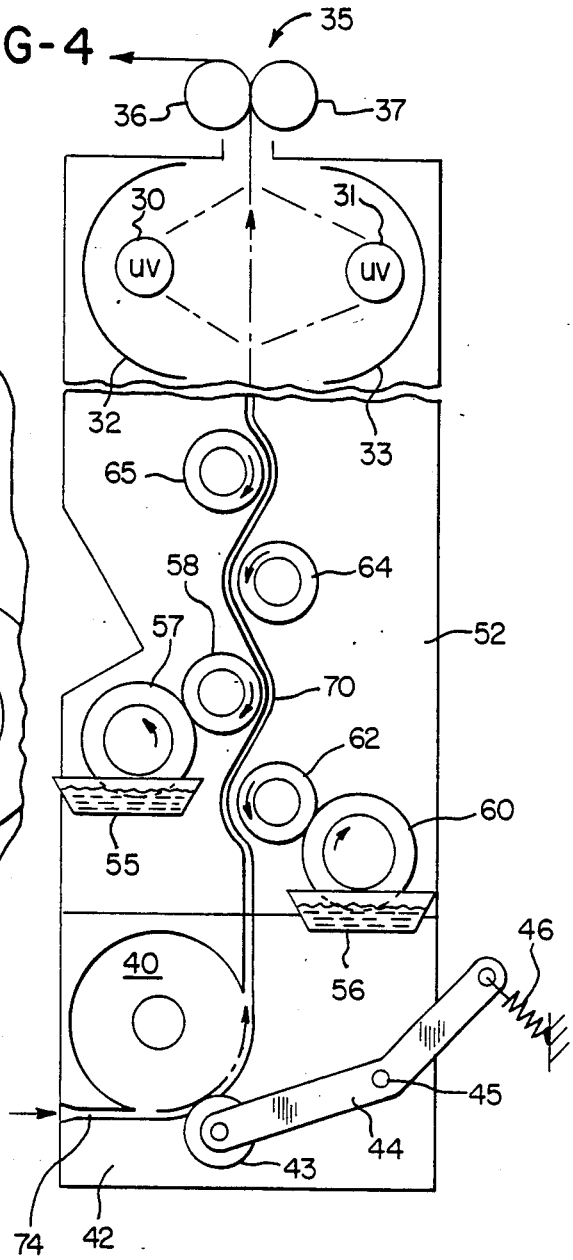
FIG. 4 is a diagrammatic view showing the operation of the invention.

The double-sided coater 20 includes a pair of transversely spaced-apart side frames or walls 50 and 52 which are mounted atop the frames 41 and 42. The spacing of the side walls 50 and 52 is less than the transverse width of the leader 25. In FIGS. 3 and 4 only the side wall 52 is shown, it being understood that the side wall 50 is complementary in structure and design. The coating apparatus itself is diagrammatically illustrated in FIG. 4 as including a pair of coating pans 55 and 56. Pan 55 is associated with a pickup roll 57 therein, which applies a metered quantity of coating material to an applicator roll 58. Similarly, a pickup roll 60 is received in the pan 56 and applies a metered quantity of coating material to the applicator roll 62. The applicator rolls 58 and 62 apply the coating material to the opposite sides of a filmstrip carried upwardly through the coater 20 between these rolls.

Smoothing is accomplished by a pair of vertically staggered wire-wound smoothing bars or rolls 64 and 65. The roll 64 is positioned vertically above the applicator roll 62 and smooths the outside surface of the filmstrip while smoothing roll 65 is positioned above applicator roll 58 and smooths material applied by roll 58 on the inside surface of the film. The film is caused, in its vertical movement, slightly to wrap around each of these rolls 62, 58, 64 and 65 in succession.

The pickup rolls 57 and 60 may be constructed and operated in accordance with the teachings of the copending application and therefore may be in close but non-contacting relation to their respective applicator rolls 58 and 62 with a spacing therebetween of approximately 0.002 inch. The rolls are preferably mounted at their opposite ends, in the vertical frame members 50 and 52 and may be mounted in eccentric bearing supports permitting fine adjustments to be made in the spacing between the rolls to control the amount of coating material applied to either side of the film. The respective applicator rolls 58 and 62 are rotated in a direction contrary to the direction of movement of the film therepast, as illustrated by the arrows thereon in FIG. 4 with a slight wrap of the film around in the order of from about 5°–10°.

The smoothing rolls or bars 64 and 65 are preferably wound with fine wire which presents to the film surface a finely grooved surface consisting of adjacent turns of wire tightly wrapped about the bars. The smoothing rolls likewise turn in a direction contrary to the direction of movement of the film, for smoothing the coating applied thereto.

As previously noted, the coater 20 includes means for guiding the leader 25 through the coater in non-contacting relation with coater elements. These means include complementary generally vertically aligned grooves or passageways 70 formed in the inside surfaces of the respective side walls 50 and 52 of the coater. The passageways 70 are generally serpentine in that they each define a pathway which receives and carries the leader upwardly between the offset coating rolls 58 and 62 and between the smoothing bars 62 and 65 in non-contacting relation to the rolls and bars. Thus, the major portion of each of the complementary passageways 70 are wavy or sinusoidal in nature, as illustrated by the enlarged detail of FIG. 3. An entrance passageway 74 is formed in the frame or base members 41 and 42 of input section about the drive roll 40, to feed the leader into the lead-in end of the vertical slot 70. While the slot 70 is shown in the coater frame 52, a complementary slot is formed in the opposite frame 50.

Figure 2:
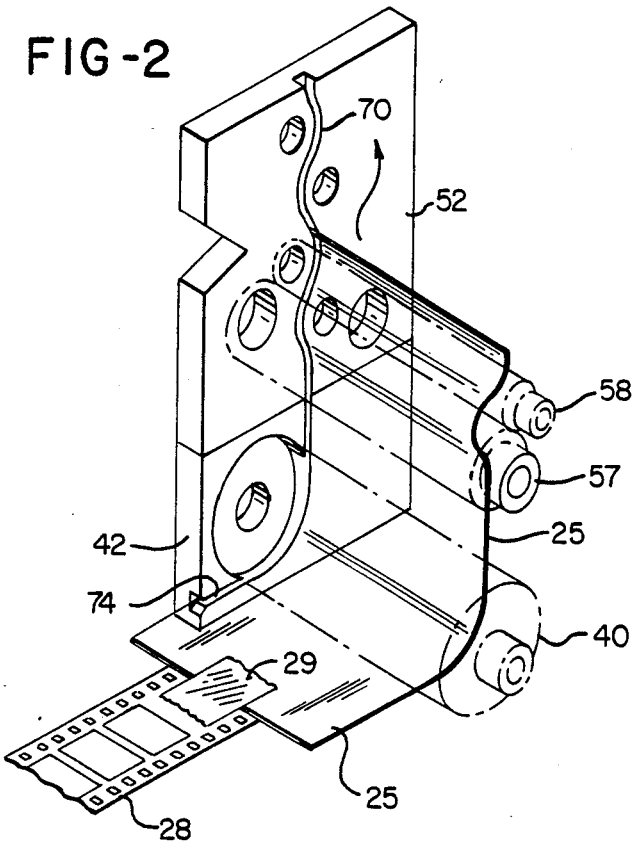
FIG. 2 is a partial perspective view of a portion of the coater apparatus showing the leader in relation to one of the coater side walls.

Since the side walls or frames 50 and 52 are formed with complementary slots, to receive the respective transverse edges of the leader, the leader 25 will move through the coating apparatus without contact with coating or smoothing rolls as shown in FIGS. 2 and 3. However, the trailing film will thereafter be drawn over the coating and smoothing rolls so that accurate amounts of coating material are applied by the offset coating rolls and smoothed by the respective smoothing bars or rolls since the width of the attached filmstrips are less than the width of the leader.

The slots 70 in the side plates or frames of the coater 20 provide means to receive the lateral edges of the leader for guiding the leader 25 through the coater in non-contacting relation to the coating rolls or smoothing rolls. If required, a small strip of stiffener material may be applied transversely of the leader along the leading edge. Such strips should have a transverse length less than the width of the leader so as not to extend into either of the slots 70 for the purpose of stiffening the leader and preventing buckling, where undesired buckling could cause the leader to snap out of the guideways or slots 70.

It will therefore be seen that the coater of the present invention is self-threading. It is only necessary to feed the leader into the lead-in slot 74 and between the drive roll 40 and the pinch roll. Thereafter, the leader will be driven upwardly between the side frames as guided by the complementary slots, and into the nip between the pinch rolls 36 for exit from the coater. When the pinch rolls 36 grip the filmstrip, it will be drawn through in tension over the respective offset coating rolls and smoothing bars and through the ultraviolet section for curing.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. Apparatus for applying an ultraviolet light curable coating to the opposite sides of a filmstrip in which the filmstrip is supported initially at one end on a leader the width of which substantially exceeds the width of the filmstrip, comprising:

a coater having a pair of spaced side plates forming the lateral sides of said coater, roll means in said coater between said plates for applying said coating to the opposite sides of a filmstrip drawn therethrough, vertically spaced smoothing bars between said plates adapted to engage the opposite sides of said strip for smoothing the coating thereon, and means in said side plates defining complementary generally vertically aligned passageways for receiving the opposite lateral edges of a leader therein and for causing said leader to move through said coater in non-contacting relation to the coating apparatus therein including said coating rolls and said smoothing bars while drawing an attached filmstrip therethrough.

2. The coater of claim 1 in which pairs of pinch rolls are positioned respectively above and below said coater for gripping said filmstrip and causing said filmstrip to be placed in tension as drawn through said coater.

3. A film coater apparatus particularly adapted for applying an ultraviolet curable protective coating to the opposite sides of relatively short strips of film, such as 35 millimeter strips or the like, which strips are fed to the apparatus by a plastic leader which leader exceeds the width of said strips of film, comprising:

means defining a coater having a pair of transversely spaced-apart side plates, a pair of coating rolls extending between said side plates and adapted to apply a coating to the opposite sides of a strip of film moving therebetween, a pair of smoothing rolls rotatably mounted on said side plates and adapted to engage the said opposite sides of said film for smoothing the coating applied thereto, an ultraviolet curing chamber for receiving film from said coater for curing said coating, a pair of pinch pull rolls for receiving film exiting from said coater for applying tension to said film as it passes therethrough, and means in said side plates defining complementary guide slots adapted to receive the lateral edges of said leader for guiding said leader through said coater in non-contacting relation to said coating rolls and smoothing rolls.

4. Self-threading coater apparatus for applying coating material to the opposite sides of filmstrips which are led and carried into the coater by a leader in which the leader has a width which exceeds the width of the filmstrips carried thereby, comprising:

entrance roller means for gripping the leader and the subsequent filmstrips for delivery to the coater at a controlled rate, said coater having a pair of spaced-apart side frames, the spacing between said side frame being slightly less than the width of said leader, means in said coater side frames defining leader-receiving grooves for receiving the marginal edges of said leader and for guiding said leader through said coater, said grooves defining an inlet at said entrance roller means whereby said leader is fed to said groove inlet by said entrance roller means, said grooves being complementary to each other for carrying said leader through said coater in non-contacting relation to coating means therein.

* * * * *